US005879188A

United States Patent [19]

Clyatt

[11] Patent Number: 5,879,188

[45] **Date of Patent: *Mar. 9, 1999**

[54] COAXIAL CONNECTOR

[75] Inventor: Clarence L. Clyatt, Goodyear, Ariz.

[73] Assignee: Elco U.S.A. Inc., Myrtle Beach, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 729,436

[22] Filed: Oct. 11, 1996

[51] Int. Cl.[6] ..... H01R 17/18

[52] U.S. Cl. ..... 439/578; 439/675

[58] Field of Search ..... 439/578, 583, 439/584, 851, 841, 842, 852, 675

[56] References Cited

U.S. PATENT DOCUMENTS

| | | | |
|---|---|---|---|
| 2,490,622 | 12/1949 | Cork | 178/44 |
| 3,171,707 | 3/1965 | Powell | 339/177 |
| 3,323,083 | 5/1967 | Ziegler | 439/578 |
| 3,336,563 | 8/1967 | Hyslop | 439/578 |
| 3,496,496 | 2/1970 | Fiebel et al. | 333/33 |
| 3,671,922 | 6/1972 | Zerlin et al. | 339/74 R |
| 3,828,304 | 8/1974 | Winn | 339/177 R |
| 4,326,769 | 4/1982 | Dorsey et al. | 339/177 E |
| 4,690,482 | 9/1987 | Chamberland et al. | 439/578 |
| 4,917,630 | 4/1990 | Hubbard | 439/578 |
| 4,925,403 | 5/1990 | Zorzy | 439/578 |
| 5,074,809 | 12/1991 | Rousseau | 439/675 |
| 5,092,784 | 3/1992 | de Mendez et al. | 439/578 |
| 5,166,477 | 11/1992 | Perin, Jr. et al. | 174/74 R |
| 5,295,863 | 3/1994 | Cady | 439/578 |
| 5,327,111 | 7/1994 | Gipprich | 333/260 |
| 5,474,470 | 12/1995 | Hammond, Jr. | 439/578 |
| 5,562,506 | 10/1996 | Wright | 439/578 |

FOREIGN PATENT DOCUMENTS 6176825 6/1994 Japan .

*Primary Examiner*—Paula Bradley
*Assistant Examiner*—Tho Dac Ta
*Attorney, Agent, or Firm*—Dority & Manning, P.A.

[57] ABSTRACT

A subminiature coaxial connector including a matched impedance plug and jack for coupling printed circuit boards, RF modules, coaxial cables and the like, and minimizing RF signal losses and/or degradations. The plug and jack each comprises a coaxial structure including an outer tubular conductor and a center contact held in place by a dielectric sleeve within the outer tubular conductor. The geometries of these elements are such that when the plug and jack are fully joined, the elements are coextensive and butt-mated, without steps, gaps or other discontinuities.

8 Claims, 9 Drawing Sheets

COAXIAL CONNECTOR

FIELD OF THE INVENTION

The present invention relates generally to RF connectors and more particularly to subminiature, matched impedance RF connectors for releasably coupling printed circuit boards, RF modules, flexible and semirigid coaxial cables, and the like.

BACKGROUND OF THE INVENTION

An RF connector, sometimes called a coaxial connector, is that part of an electrical signal transmission system which allows for the coupling and uncoupling of system-interconnecting conductors forming part of printed circuit boards (PCBs), RF modules, coaxial cables and so forth. For example, in many apparatus flexible or semirigid coaxial cables of small diameter (less than ⅛-inch) are used to transmit RF signals having frequencies exceeding 10 GHz. As is well known, such coaxial cables comprise an inner or center wire conductor disposed coaxially within a shielding outer tubular conductor with a dielectric or insulating material interposed between the inner and outer conductors. To avoid degradation of the quality of the RF signal being transmitted, connectors used to couple coaxial cables should present to the signal the same characteristic impedance as the cables and should minimize losses in the continuity of the electric field developed by the signals being transmitted.

Known high frequency signal coaxial connectors typically include a pair of connector elements adapted to be releasably coupled, one referred to as the receptacle or jack and the other as the plug. These elements are of generally cylindrical shape and include a central contact (in the form of either a socket or pin) and an outer tubular conductor separated by an insulating or dielectric sleeve. The jack and plug connector elements have mateable end portions whose construction is critical to minimizing signal degradation and/or loss.

In accordance with one known construction, exemplified by U.S. Pat. Nos. 5,074,809; 5,474,470; and 4,690,482, the plug includes an outer tubular conductor having a male contact portion that is slotted so as to define spring contact fingers. The receptacle connector element includes a tubular outer conductor housing whose inner surface comprises a female contact part for receiving the male contact part of the plug connector element. To assure good electrical contact between the contact parts of the plug and receptacle, the spring contact fingers on the plug may be spread or flared outwardly and/or provided with outwardly extending projections adjacent to the extremities of the fingers. Such conventional RF coaxial connectors have several disadvantages, stemming principally from discontinuities in the plug and jack assembly resulting in RF signal degradation and/or loss. These RF coaxial connectors also tend to be relatively large and complex.

FIGS. 1–11 show details of common types of conventional, prior art subminiature RF coaxial connectors. With reference first to FIGS. 1–4, there is shown a prior art coaxial connector 10 including a jack 12 and a plug 14 adapted to be coupled or assembled so as to interconnect a pair of coaxial cables (not shown) the ends of respective ones of which are attached to the jack and plug in a manner well known in the art.

The jack 12 includes a generally tubular outer conductive housing 16 having an outer surface 18 and a mateable end portion 20 provided with a plurality of longitudinally extending slots 22 (typically 4 in number) thereby defining a plurality of finger contacts or beams 24. The outer surface 18 of the housing 16 is stepped so as to define a radially extending abutment surface 26 rearward of the roots of the beams 24. The mateable end portion 20 has a forward extremity 28. Bevels 30 at the forward ends of the beams 24 facilitate assembly of the jack 12 and plug 14. The outer surfaces of the beams 24 and the bevels 30 intersect at an edge 32. Disposed within the mateable end portion 20 of the jack is an insulating or dielectric sleeve 34 having a front face 36 coplanar with the forward extremity 28 of the end portion 20. The sleeve 34 includes a central bore 38 for receiving a center contact which has been omitted for clarity.

The plug 14 includes a generally tubular outer conductive housing 40 having an inner wall 42 of diameter D2 and a front annular face 44. Disposed within the housing 40 is an insulative or dielectric sleeve 46 having a central bore 47 for receiving a center contact (not shown) and a planar front surface 48 set back from the end face 44 so as to define a mateable end portion 50 of the plug 14.

As shown in FIG. 2, the beams 24 are spread or flared radially outwardly. Before the beams 24 are flared, the mating outside diameter (D1 in FIG. 1) of the jack 12 is a clearance fit with the mating inside diameter (D2) of the inner wall 42 of the plug outer conductor 40. The beams 24 of the jack 12 must be flared radially outward to dimension A (where A is greater than D2) to assure electrical contact with the inner surface 42 of the mating plug 14. The flaring operation, however, adds one dimension and an associated tolerance along with an additional tolerance for the symmetry of the flare. When the prior artjack 12 and plug 14 are mated (FIGS. 3 and 4), the beams 24 deflect radially inward. Electrical contact between the jack and plug outer conductors 16 and 40 occurs between arcuate portions of the edge 32 at the extreme front of the jack beams 24 and the inner wall 42 of the plug outer conductor 40. The abutment surface 26 on the outer housing 16 of the jack functions as a mechanical stop engaged by the front face 44 of the plug outer conductor 40 and defines the length of a coax interface gap 52 (FIG. 4) when the jack 12 and plug 14 are fully mated. The abutment surface 26 has no electrical function except the possible reduction of RF leakage when the surfaces 26 and 44 are in engagement. There are no electrical butt-mating surfaces at the coax interface; instead a gap, such as the gap 52, is intentionally provided to produce an inductance to offset the capacitance produced by the difference between the diameters of the dielectric sleeves 34 and 46.

Since the inside diameter (D2) of the plug outer conductor housing 40 is larger than the outside diameter (D1) of the mating portion 20 of the jack outer conductor housing 16, the diameter of the center bore 47 of the plug dielectric sleeve 46 must be larger than the diameter of the center bore 38 of the jack dielectric sleeve 34 in order for the impedance of the plug and jack to be equal. These step changes across the mated interface make the gap 52 necessary to minimize RF losses. However, at higher frequencies ($f \geqq 10$ GHz), despite the attempt to compensate for the step changes at the interface, significant RF losses remain.

With reference now also to FIGS. 9–11, for the connector shown in FIGS. 1–4, circumferential contact between the outer conductor housings 16 and 40 occurs only at arc segments where the front edges 32 of the beams 24 contact the mating inner wall 42 of the plug 14. In FIGS. 9 and 10, the arc segments along which contact occurs are designated by X while the arc segments along which there is no contact arc denoted by Y; it will be seen that Y is substantially greater than X. Nor is there any contact along the longitudinally extending edges 23 of the beam slots 22 (FIGS. 9 and 10). The signal current patterns that are understood to be produced in this connector are depicted by the broken lines in FIGS. 10 and 11. The substantial areas of electrical discontinuities will be apparent from these Figures.

If the beams 24 are not flared radially outward as shown in FIG. 2, the configuration of the plug or jack of the prior art must be altered in some way to assure electrical contact between the outer conductor housings 16 and 40 when the plug and jack are mated. Two examples follow and each has the disadvantages described with reference to the prior art embodiment of FIGS. 1–4.

With reference first to prior art FIGS. 5 and 6, a raised projection or ridge 56 may be added to the outer surface of each jack beam 24 adjacent to the forward extremity 28. The outside diameter (D3) of the ridge 56 must be larger than the mating inner diameter (D2) of the plug 14. The outside surface of the jack dielectric sleeve 34 in the area under the beams 24 must be relieved to provide an annular clearance 58 for beam deflection when the plug and jack are mated. Electrical contact is maintained along the line of contact between the ridge 56 and the inner wall 42 of the plug housing 40.

With reference to FIGS. 7 and 8 showing yet another prior art connector, the mating portion 50 of the plug 14 may be tapered outwardly toward the front extremity 44 at an angle $\theta$ from a root diameter (D4). The angle $\theta$ is greater than the final angle of deflection $\phi$ of the beams 24 of the jack to assure that electrical contact is maintained at the extreme front edge of the jack beams when the plug and jack are fully mated. As in the example of FIGS. 5 and 6, the jack dielectric sleeve 34 must be relieved to provide an annular clearance 58 to accommodate beam deflection.

Thus, an overall object of the present invention is to provide an improved ultra high frequency connector that significantly decreases RF signal losses and degradation.

Another object of the present invention is to provide a connector that is relatively simple, comprising few parts, and that can be made small enough so that an array of such connectors may be mounted side-by-side on standard 0.100-inch centers so that they can be incorporated in standard, multicontact insulating connector bodies or can be used to interconnect printed circuit boards, for example.

SUMMARY OF THE INVENTION

In accordance with the broad aspects of the present invention there is provided a subminiature, matched impedance RF coaxial connector including a plug and jack having mateable end portions whose geometries are such that when these portions are joined the electrical discontinuities and hence the losses and/or degradation of signals passing through the connector are minimized. The plug and jack each comprise coaxial assemblies including an outer tubular conductor having concentrically positioned therein a center contact which is held fixedly in place by a dielectric sleeve.

In accordance with one specific form of the invention, the outer tubular conductor of the plug is longitudinally slotted so as to define a plurality of compliant beams. The outer tubular conductor has an inner wall that is stepped so as to define a planar abutment surface extending radially relative to the longitudinal central axis of the outer conductor. The mateable end portion of the plug extends between the abutment surface and a front extremity of the plug. The center contact of the plug is stepped so as to define a main center contact body and a contact pin having a smaller diameter than the main body of the center contact. The stepped transition of the center contact is in the form of a radially extending shoulder coplanar with the abutment surface on the inner wall of the outer conductor. The dielectric sleeve, disposed between the inner wall of the main portion of the outer conductor and the main body of the center contact has a front surface coplanar with the afore-described abutment surface and shoulder.

The outer tubular conductor and center contact of the jack have front extremities that are coplanar, lying in a radially extending plane. Likewise, the dielectric sleeve of the jack includes a front, flat extremity lying in the same radial plane. The center contact of the jack includes a socket for receiving the contact pin of the center contact of the plug. The thickness of the wall of the outer tubular conductor of the jack is equal to the width of the abutment shoulder on the inner wall of the outer conductor of the plug; similarly, the wall thickness of the socket of the jack center contact is equal to the width of the shoulder on the center contact of the plug. The dimensions of the plug and jack elements are such that when the mateable end portions of the plug and jack are joined, the outer tubular conductors, the dielectric sleeves and the center contacts of the plug and jack form continuous structures, with the front extremities of the outer conductor and center contact of the jack engaging, respectively, the abutment surface and shoulder of the outer conductor and center contact of the plug. The front faces of the dielectric sleeves are in congruent relationship when the plug and jack and fully mated.

Further in accordance with the invention, the inner wall of the mateable end portion of the plug and the outer wall of the mateable portion of the jack are dimensioned for a locational interference fit which assures firm mechanical engagement and electrical contact between the plug and jack.

The construction of the connector in accordance with the present invention virtually eliminates all steps and other discontinuities in the connector interface so as to minimize attenuation of the signals passing through the connector. The connector of the present invention moreover has a simple structure having fewer components than conventional connectors and lends itself to reductions in size so that the connectors can be located on 0.100 inch centers and used as contacts in standard multicontact connector bodies. As stand alone or discrete connectors, the connectors of the present invention may be terminated to flexible or semirigid coaxial cables, or mounted on boards or panels.

BRIEF DESCRIPTION OF THE DRAWINGS

Further objects, features and advantages of the invention will become apparent from the "Detailed Description of the Preferred Embodiments", below, when read in conjunction with the accompanying drawings, in which.

DETAILED DESCRIPTION OF THE PREFERRED EMBODIMENTS

The following description presents preferred embodiments of the invention representing the best mode contemplated for practicing the invention. This description is not to be taken in a limiting sense but is made merely for the purpose of describing the general principles of the invention whose scope is defined by the appended claims.

Figure 1:
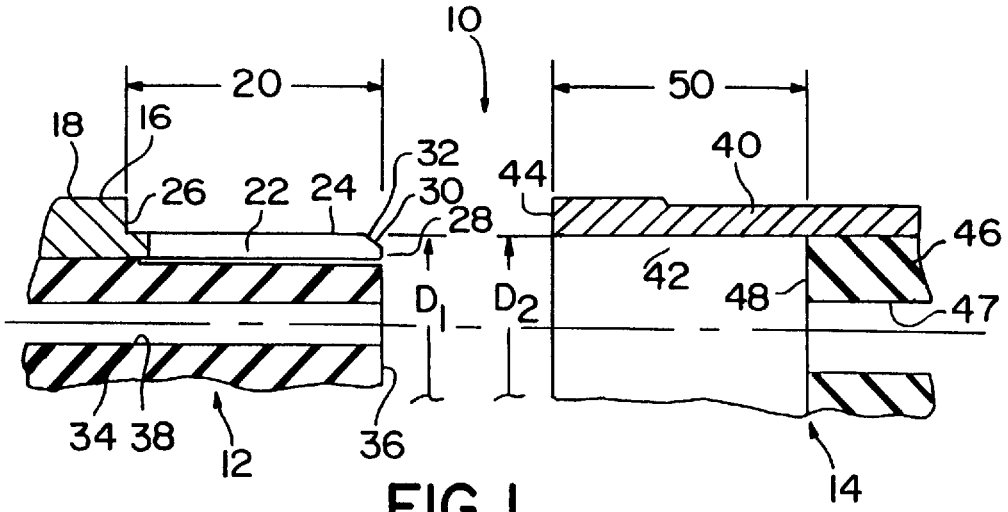
FIG. 1 PRIOR ART
FIGS. 1–8 are longitudinal cross section views of portions of the jack and plug elements of RF coaxial connectors in accordance with the prior art.
Figure 2:
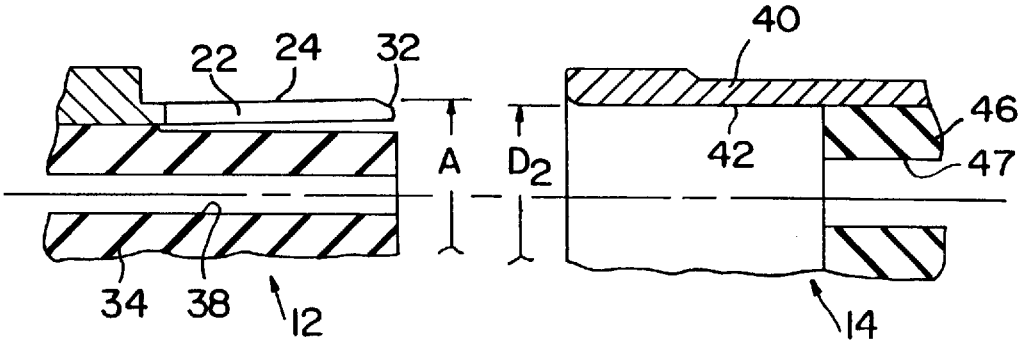
FIG. 2 PRIOR ART
Figure 3:
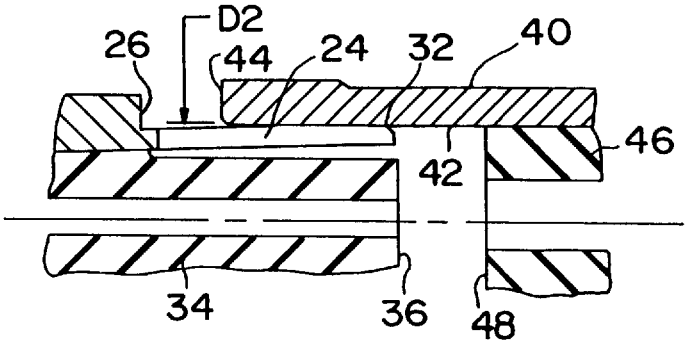
FIG. 3 PRIOR ART
Figure 4:
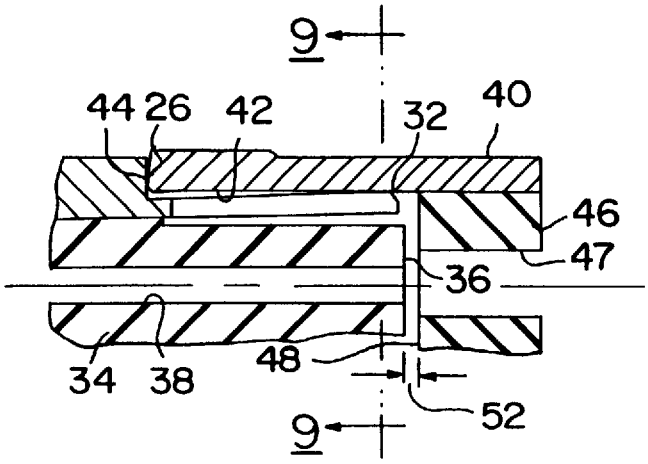
FIG.4 PRIOR ART
Figure 5:
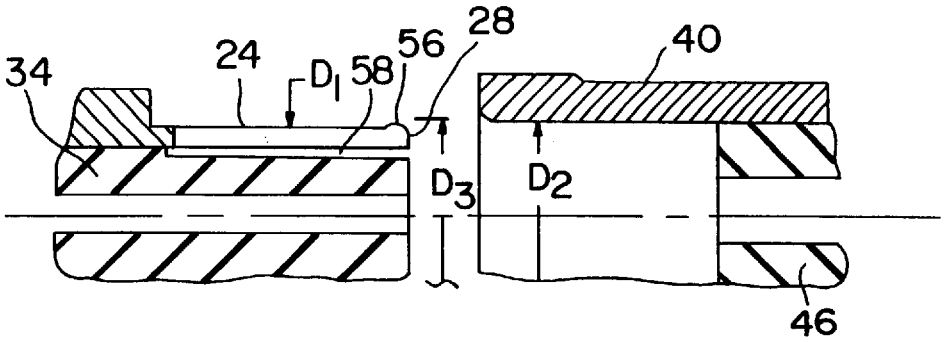
FIG.5 PRIOR ART
Figure 6:
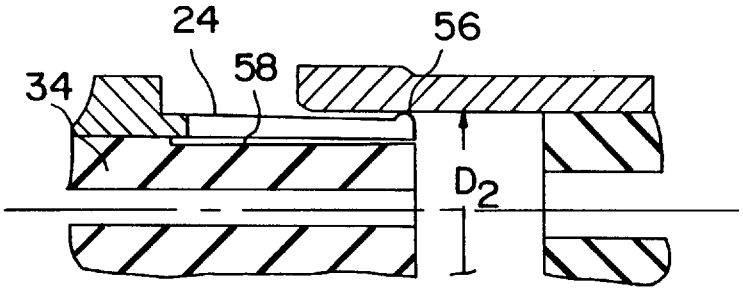
FIG.6 PRIOR ART
Figure 7:
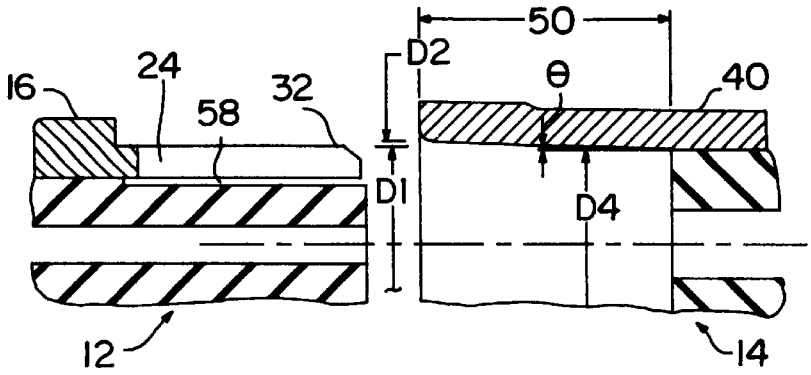
FIG. 7 PRIOR ART
Figure 8:
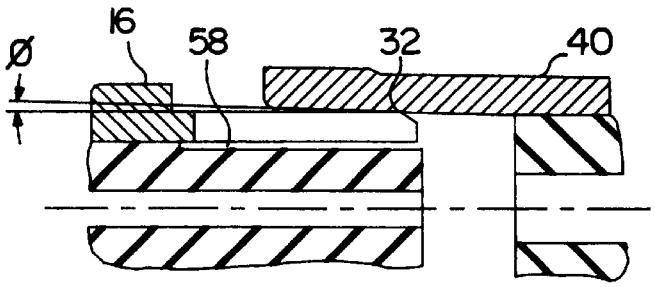
FIG. 8 PRIOR ART
Figure 9:
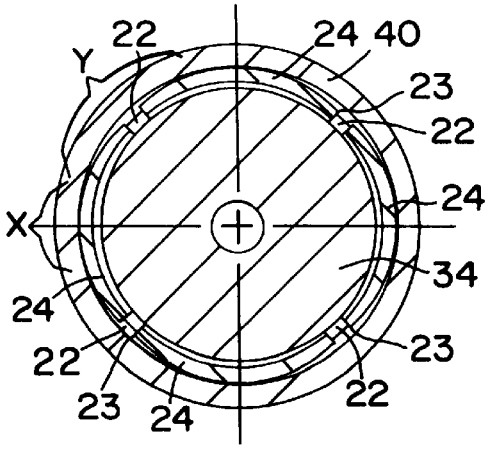
FIG. 9 PRIOR ART
FIG. 9 is a radial cross section view of the prior art connector element of FIG. 4 as seen along the line 9—9 in FIG. 4.
Figure 10:
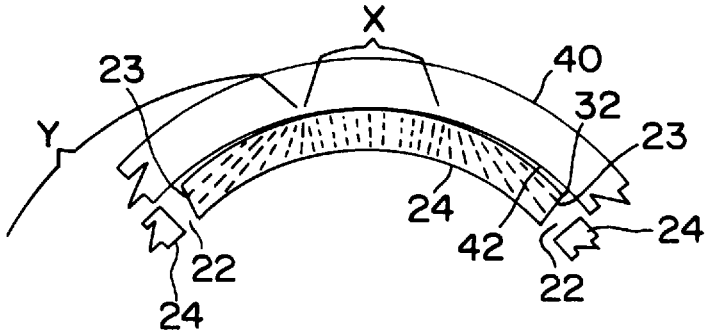
FIG.10 PRIOR ART
FIG. 10 is an enlargement of a portion of the cross section view of FIG. 9.
Figure 11:
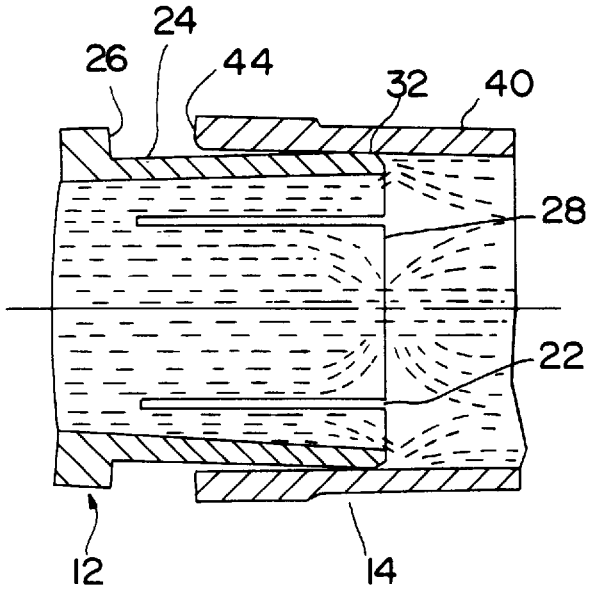
FIG.11 PRIOR ART
FIG. 11 is a longitudinal cross section view similar to FIG. 3 of a prior art RF coaxial connector showing an approximation of the signal current patterns therein.
Figure 12:
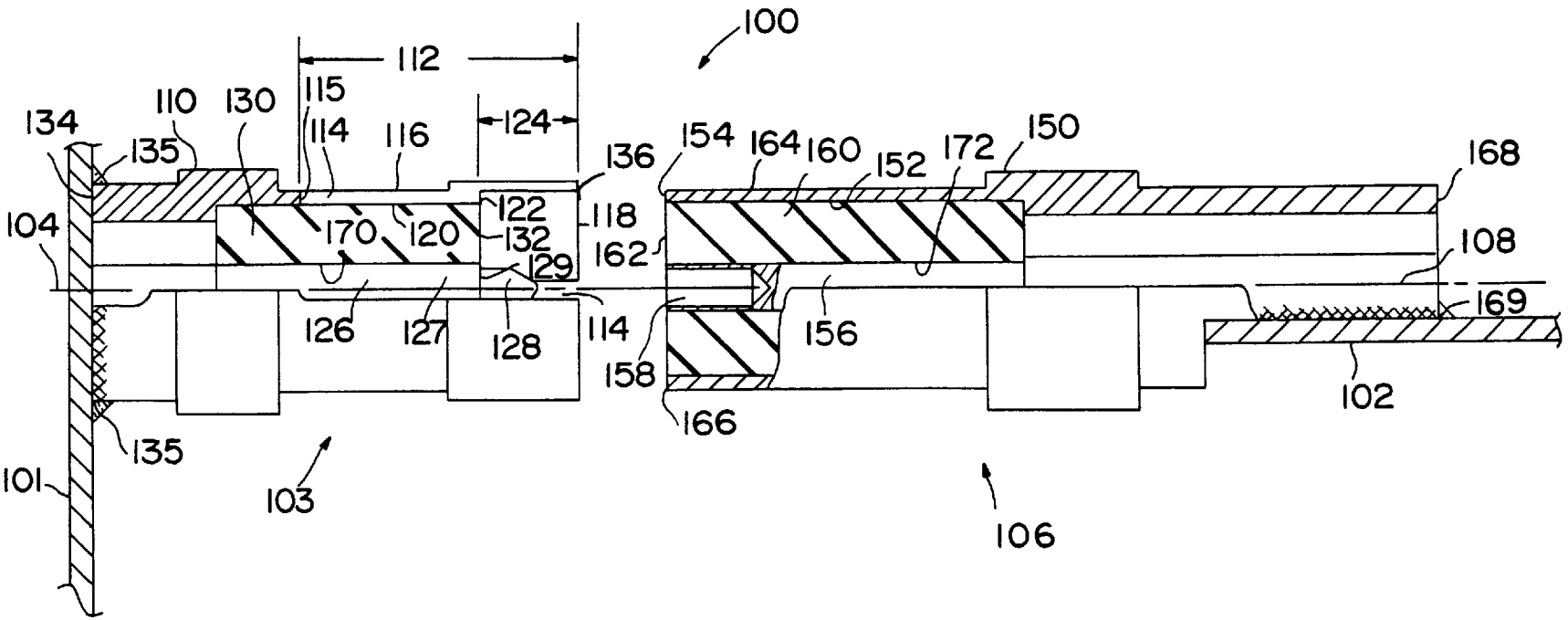
FIGS. 12 and 13 are longitudinal cross section views of portions of the plug and jack elements of an RF PCB connector in accordance with the present invention.
Figure 13:
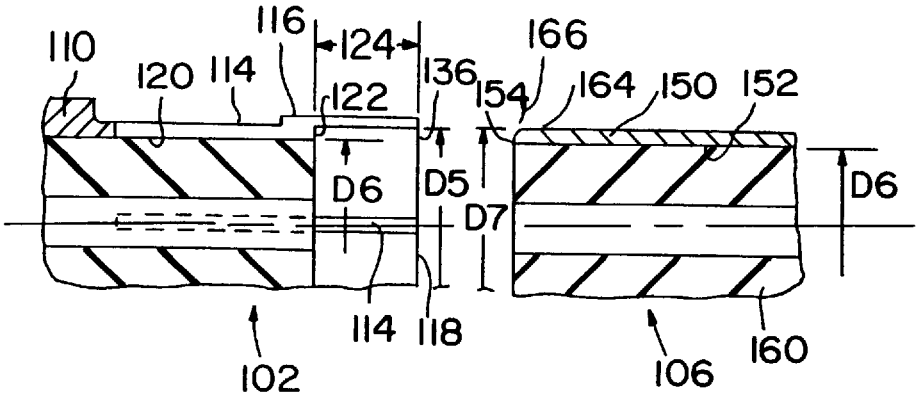

FIG. 12 shows a connector assembly 100 in accordance with one embodiment of the present invention for coupling conductors on a pair of printed circuit boards (PCBs) 101 and 102 disposed perpendicular to each other. The connector assembly of the invention comprises a vertical surface mount plug 103, having a longitudinal central axis 104 perpendicular to the faces of the PCB 101, and a right angle surface mount jack 106 having a longitudinal central axis 108 parallel with the faces of the PCB 102. The plug 103 includes an outer tubular conductor 110 a portion 112 of which is provided with a plurality of slots 114 (for example, four in number) to define a plurality of compliant fingers or beams 116 having front extremities 118 lying in a radial plane perpendicular to the longitudinal axis 104. As shown, slots 114 extend axially back from the front extremity 118 to a base location 115 wherein outer conductor 110 becomes annularly continuous. The outer conductor 110 includes an inner wall 120 having a step defining a radially extending planar abutment surface 122. The portion of the plug 103 extending forwardly from the abutment surface 122 to the front extremities of the beam comprises a mateable end portion 124 of the plug 103. The plug further includes a cylindrical center contact 126, coaxial of the tubular outer conductor 110. The center contact 126 comprises a main body 127 and contact pin 128, having a diameter smaller than the main pin body 127, that projects part way into the mateable end portion 124 of the plug. The main body 127 and the contact pin 128 define at their intersection a shoulder 129 coplanar with the abutment surface 122. Interposed between the inner wall 120 of the outer conductor 110 and the main body 127 of the center contact pin 126 is an insulative or dielectric sleeve 130 having a front, planar, radially extending annular surface 132 coplanar with the abutment surface 122. The tubular outer conductor 110 of the plug further includes a rear end 134 soldered at 135 to a ground trace on the PCB 101. Referring now also to FIG. 13, the inner wall 120 within mateable end portion 124 of the plug 103 has an inside diameter, D5, that is stepped down to a diameter, D6, at the abutment surface 122. The front extremities 118 of the beams 116 have inner edges 136 that are rounded or chamfered to facilitate coupling of the plug 103 the jack 106.

The jack 106 includes a tubular outer conductor 150 having an inner wall 152 and a front extremity 154 lying in a radial plane perpendicular to the axis 108. The jack 106 further has a coaxially disposed cylindrical center contact body 156 defining at its front end a center contact socket 158 (FIG. 12). The outer diameter of the contact body 156 is identical to the outer diameter of the main body 127 of the center contact 126 of the plug 103. As will be described in greater detail in connection with the embodiment of FIGS. 19–24, the wall of the socket 158 may be configured for secure electrical and mechanical contact with the contact pin 128. A dielectric sleeve 160 is interposed between the inner wall 152 of the tubular outer conductor 150 and the center contact body 156. The dielectric sleeve 160 has a front, annular face 162 coplanar with the front extremity 154 of the outer conductor 150. The inner wall 152 of the outer conductor 150 has a diameter D6, that is, a diameter equal to that of stepped down portion of the inner wall 120 of the plug 103. It will thus also be evident that the outer diameters of the dielectric sleeves 130 and 160 are identical (D6). The outer conductor 150 of the jack 106 includes an outer surface 164 having a diameter D7. The outer edge 166 of the front extremity 154 of the outer conductor of the plug is rounded or chamfered to facilitate coupling of the jack and jack. The plug 106 further includes a rear portion 168 soldered at 169 to a ground trace on the PCB 102.

The plug sleeve 130 has a central bore 170 for receiving the main body 127 of the center pin 126. Similarly, the jack sleeve 160 has a central bore 172 for receiving the center contact body 156. The diameters of the bores 170 and 172 are identical, and accordingly, the front annular surfaces 132 and 162 of the sleeves 130 and 160 have identical geometries and dimensions.

The diameters D5 and D7 are dimensioned for a locational interference fit, a standard fit classification defined as one used where accuracy of location is of prime importance and for parts requiring rigidity and alignment with no special requirements for bore pressure. Such fits are not intended for parts designed to transmit frictional loads from one part to another by virtue of the tightness of the fit, since these conditions are covered by force fits. Thus, by way of example, D5 may range from 0.0705 to 0.0720 inch while D7 may range from 0.0720 to 0.0735 inch.

Unlike the prior art, the beams 116 are not flared. Therefore, the flare dimension, its tolerance, and the tolerance on the symmetry of the flaring operation are eliminated. Ridges, tapers, or other beam configurations previously employed are not required to assure proper RF electrical contact between the plug and jack outer conductors in accordance with the present invention.

Figure 14:
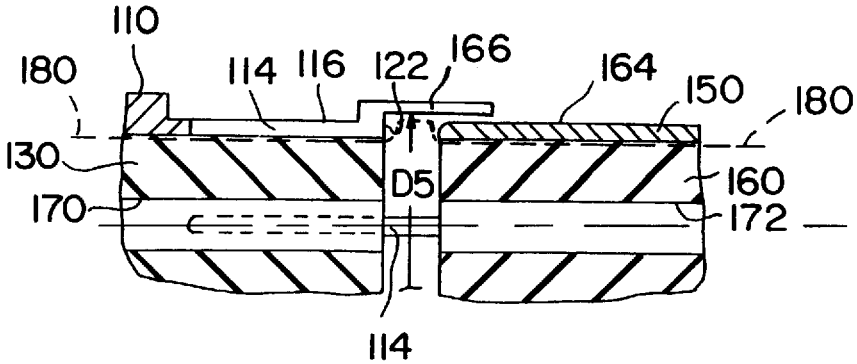
FIGS. 14 and 15 are longitudinal cross section views of the connector elements of FIGS. 12 and 13 shown, respectively, in their partially and fully assembled configurations.

With reference to FIG. 14, the beams 116 of the plug 103 deflect radially outward as the plug and jack are mated due to the interference between diameters D5 and D7. As the conductors are mated, electrical contact is maintained between the outer diameter edge 166 at the extreme front of the jack outer conductor and the inner wall 120 of the plug outer conductor along the mateable end portion 124.

Figure 15:
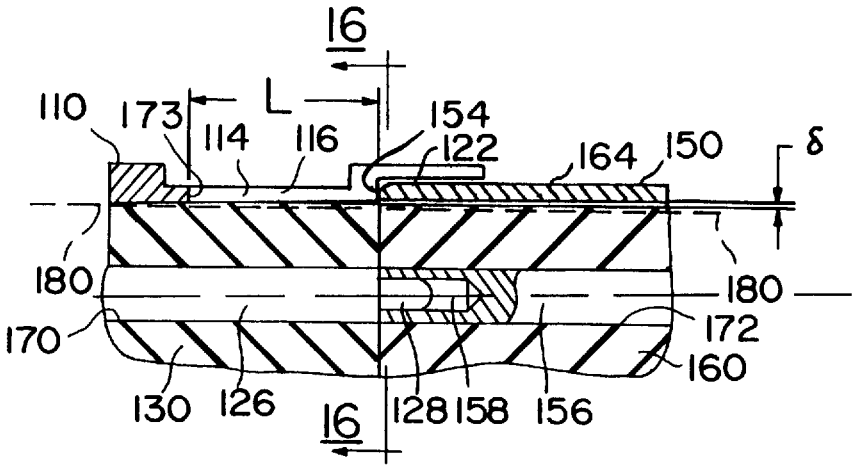

With reference to FIG. 15, the abutment surface 122 of the plug 103 is a mechanical stop engaged by the front extremity 154 of the jack outer conductor 150. Mechanically, the abutment surface 122 limits plug and jack engagement. The beam length (L) (FIG. 15) from the base 173 of the slots 114 to the abutment surface 122 is chosen so that the deflection (δ) at the surface 122 will not cause the beams 116 to yield as the plug and jack are mated to their maximum limit. As shown in FIG. 14, the current path 180 has no reverse legs and when the plug and jack are fully mated (FIG. 15), there are no radial steps in the current path.

Electrically, when the plug and jack are fully mated, i.e., butt-mated (FIG. 15), the outer conductors 110 and 150 form a continuous tubular conductor of constant inside diameter across the mated interface. Similarly the dielectric sleeves 130 and 160 are continuous, having equal outside and bore diameters. Consequently, compensation steps and/or offsets in the dielectric sleeves or center conductors are not required. When the plug and jack are fully mated, the front faces 132 and 162 of the dielectric sleeves 130 and 160 are in engagement and congruent (FIG. 15).

Figure 16:
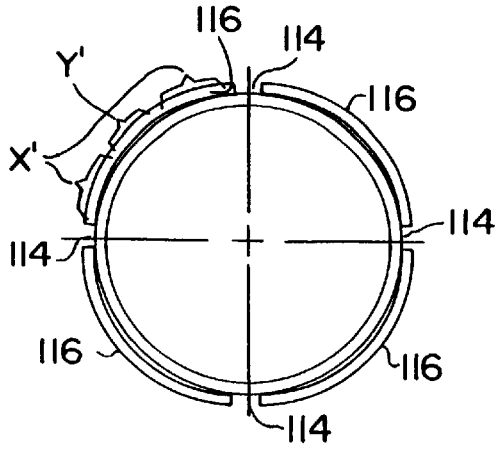
FIG. 16 is a cross section view of the connector elements of FIG. 15 as seen along the line 16—16 in FIG. 15.
Figure 17:
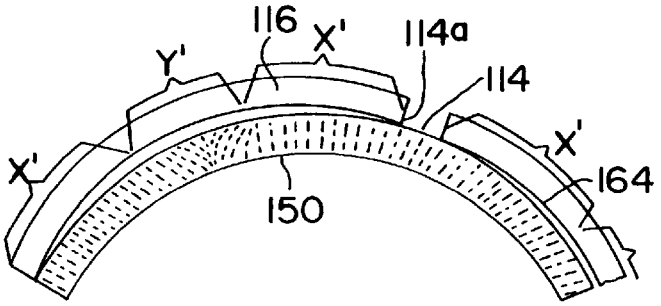
FIG. 17 is an enlargement of a portion of FIG. 16.
Figure 18:
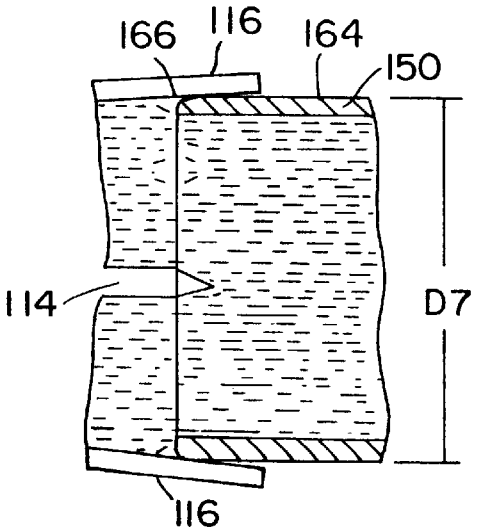
FIG. 18 is a longitudinal cross section view of portions of an assembled RF connector in accordance with the present invention showing an approximation of the signal current patterns therein.

With reference to FIGS. 16 and 17, in which the larger areas X' designate contact segments and the smaller areas Y' denote non-contact segments, circumferential contact between the outer conductors 110 and 150 is approximately 75% to 80% continuous due to the closely matched curvatures of the mating diameters and guaranteed contact between the front outer edge 166 of the jack and a line of contact around the mating inside surface of the jack. Except for the slots themselves, this contact line spans across each beam slot 114 and includes the slot edges 114*a* (FIG. 17). As shown in FIGS. 17 and 18, interruption and distortion of the signal current pattern (shown in broken lines) is minimal resulting in improved RF performance at frequencies above 10 GHz. When the outer conductors are butt-mated, circumferential contact approaches 85% to 90% of the available contact circumference which further decreases distortion of the signal current pattern and RF losses at high frequencies. It will be evident to those skilled in the art that the front portion 112 of the plug 103 need not be slotted. In this case, the fit between the plug and the jack outer conductors would be a locational clearance fit, a standard fit intended for parts which are normally stationary but which can be freely assembled and disassembled. Such a non-slotted version is advantageous for precision RF applications where the outer tubular conductors 110 and 150 must maintain a butt-mated condition under compressive force.

Figure 19:
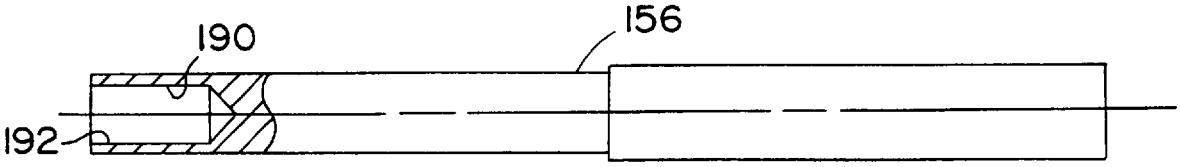
FIG. 19 is a side view, partly in cross section, of a center contact socket element that may be employed in an RF connector according to the present invention.
Figure 20:
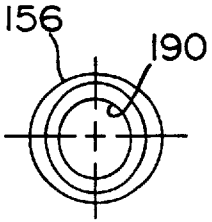
FIG. 20 is an end view of the center contact socket element shown in FIG. 19.

FIGS. 19–22 show two configurations that the center contact body 156 of the jack 106 may take to assure a secure electrical connection with the contact pin 128 of the center contact 126 of the plug 103. In FIGS. 19 and 20, the center contact body 156 includes a socket 190 at the forward end thereof for receiving the contact pin 128. The socket 190 and contact pin 128 may be initially dimensioned for a locational clearance fit, as defined above. In the embodiment of FIGS. 19 and 20, the wall defining the entry portion 192 of the socket 190 is deformed into a slightly oval configuration to provide the mechanical interference and compliance necessary for good electrical contact and mateability between the socket 190 and contact pin 128.

Figure 21:
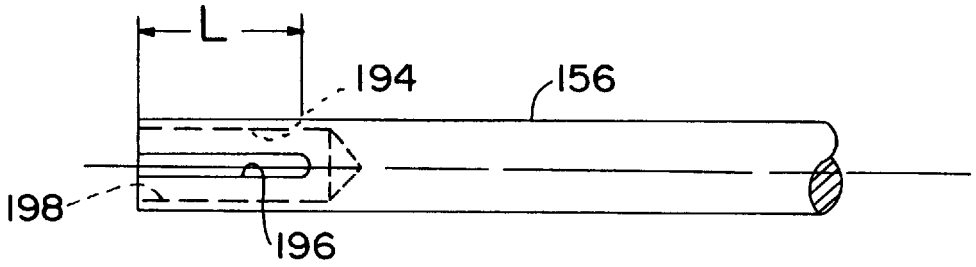
FIG. 21 is a side view of an alternative embodiment of a center contact socket element that may be employed in an RF connector according to the present invention, said contact socket element being shown in its configuration prior to the final forming operation.
Figure 22:
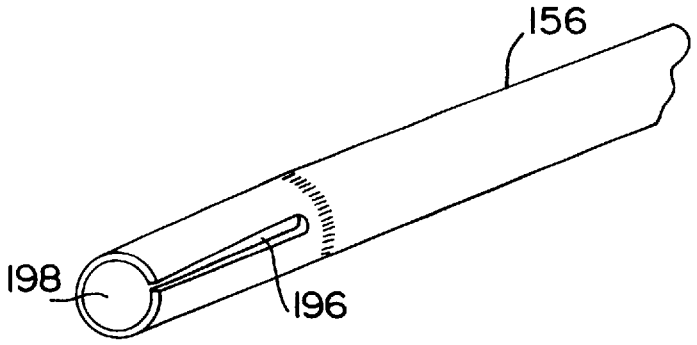
FIG. 22 is a perspective view of the contact socket element of FIG. 21 in its final configuration.

FIGS. 21 and 22 show an alternative embodiment of the center contact body 156 which includes a pin-receiving socket 194 initially dimensioned for a locational clearance fit with the contact pin 128. The wall of the socket 194 is provided with a single, longitudinally extending slot 196 of predetermined length, L. As shown in FIG. 22, the diameter of the entry 198 of the socket 194 is reduced by squeezing, crimping, or the like, to a dimension slightly smaller than the diameter of the pin of the jack center contact to provide the necessary mechanical interference and compliance.

It should be appreciated that the foregoing description is only illustrative of the invention. Various alternatives and modifications can be devised by those skilled in the art without departing from the spirit of the invention. Accordingly, the present invention is intended to embrace all such alternatives, modifications and variations as fall within the scope of the appended claims.

What is claimed is:

1. A coaxial connector comprising:

a plug including a tubular outer conductor having a longitudinal center axis and a front extremity, the tubular outer conductor defining a plurality of longitudinal slots extending along the tubular outer conductor from the front extremity to a base location axially spaced from the front extremity, said slots forming a plurality of longitudinally extending compliant beams disposed between the longitudinal slots, the tubular outer conductor including an inner wall defining a radially extending abutment surface being disposed at an axial location between the base of the longitudinal slots and the front extremity of the plug, an annular dielectric sleeve being disposed within the tubular outer conductor so as to be radially inward of the compliant beams in an axial region between the abutment surface and the base of the longitudinal slots, and a center contact disposed within the annular dielectric sleeve; and a jack including a tubular outer conductor having a longitudinal central axis and an annular end portion terminating at a front extremity, the tubular outer conductor including an outer wall, an annular dielectric sleeve being disposed within the tubular outer conductor, and a center contact being disposed within the annular dielectric sleeve, upon mating of the plug and the jack, the front extremity of the jack being disposed within the compliant beams of the plug axially between the abutment surface and the front extremity of the plug, and the plug center contact being electrically coupled to the jack center contact.

2. The coaxial connector of claim 1, wherein the plug annular dielectric sleeve includes an outer cylindrical surface and an inner cylindrical surface and the jack annular dielectric sleeve includes an outer cylindrical surface and an inner cylindrical surface, the outer cylindrical surfaces of the annular dielectric sleeves of the plug and jack having substantially the same diameter and the inner cylindrical surfaces of the dielectric sleeves having substantially the same diameter.

3. The coaxial connector of claim 1, wherein the inner wall of the plug tubular outer conductor defines a mateable end portion having a first diameter and the outer wall of the jack tubular outer conductor defines a mateable end portion having a second diameter, the first and second diameters being dimensioned for a interference fit between the inner wall and the outer wall.

4. The coaxial connector of claim 1, wherein upon mating of the plug and the jack the front extremity of the jack abuts the abutment surface of the plug.

5. The coaxial connector of claim 1, wherein the plug tubular outer conductor, the jack tubular outer conductor, and the plug abutment surface all have substantially the same radial thickness.

6. The coaxial connector of claim 1, wherein one of the center contacts includes a socket and the other of the center contacts includes a pin adapted to be received by the socket.

7. The coaxial connector of claim 6, wherein the socket is defined by a wall deformed into a slightly oval configuration to provide compliance and an interference fit with the pin when the socket and pin are mated.

8. The coaxial connector of claim 6, wherein the socket is defined by a wall having a single, longitudinally extending slot of predetermined length, the socket having an entry portion of reduced diameter slightly smaller than the diameter of the pin to provide compliance and an interference fit when the socket and the pin are mated.

* * * * *

UNITED STATES PATENT AND TRADEMARK OFFICE

CERTIFICATE OF CORRECTION

PATENT NO. : 5,879,188

DATED : March 9, 1999

INVENTOR(S) : Clarence L. Clyatt

It is certified that error appears in the above-indentified patent and that said Letters Patent is hereby corrected as shown below:

In Column 2, Line 30, please change the one word "artjack" into two words "art jack"

In Column 6, Line 9, please insert the word "and" between 103 and the

In Column 6, Line 33, please change the word "jack" the first time it appears in this line, to "plug"

In Column 6, Line 34, please change the word "plug" to "jack"

In Column 7, Line 29, please change the word "jack" to "plug"

Signed and Sealed this

Twentieth Day of July, 1999

*Attest:*

*Attesting Officer*

Q. TODD DICKINSON

*Acting Commissioner of Patents and Trademarks*